US005255615A

United States Patent [19]

Magaldi

[11] Patent Number: 5,255,615

[45] Date of Patent: Oct. 26, 1993

[54] SYSTEM FOR DISCHARGING BOTTOM ASH FROM STEAM-PRODUCING BOILERS

[76] Inventor: Mario Magaldi, Viale del Bosco, 22, I-84100, Salerno, Italy

[21] Appl. No.: 773,852

[22] PCT Filed: Mar. 4, 1991

[86] PCT No.: PCT/EP91/00405

§ 371 Date: Oct. 29, 1991

§ 102(e) Date: Oct. 29, 1991

[87] PCT Pub. No.: WO91/13293

PCT Pub. Date: Sep. 5, 1991

[30] Foreign Application Priority Data

Mar. 2, 1990 [IT] Italy ..... 19554A/90

[51] Int. Cl.[5] ..... F23B 7/00

[52] U.S. Cl. ..... 110/234; 110/165 R; 110/259; 110/341

[58] Field of Search ..... 110/233, 165 R, 171, 110/234, 341, 259; 414/209, 211

[56] References Cited

U.S. PATENT DOCUMENTS

| | | | |
|---|---|---|---|
| 1,354,553 | 10/1920 | Harter . | |
| 1,452,952 | 4/1923 | Barnhurst . | |
| 1,506,803 | 9/1924 | Astrom . | |
| 1,739,497 | 12/1929 | Beach . | |
| 2,380,264 | 7/1945 | Richardson | 198/53 |
| 2,558,626 | 6/1951 | Pfau | 110/165 |
| 2,702,485 | 2/1955 | Nadherny | 74/242.14 |
| 3,633,737 | 1/1972 | Magaldi | 198/196 |
| 3,802,584 | 4/1974 | Sackett, Sr. et al. | 214/44 R |
| 3,841,241 | 10/1974 | Dewey et al. | 110/8 R |
| 4,020,956 | 5/1977 | Van Hille | 214/17 DA |
| 4,112,856 | 9/1978 | Fuhrman et al. | 110/165 R |
| 4,284,192 | 8/1981 | Taylor | 198/813 |
| 4,325,478 | 4/1982 | Richard | 198/699 |
| 4,395,958 | 8/1983 | Caffyn et al. | 110/246 |
| 4,432,772 | 2/1984 | Starke et al. | 110/165 X |
| 4,628,828 | 12/1986 | Holtham et al. | 110/165 R |
| 4,887,539 | 12/1989 | Magaldi | 110/165 |

FOREIGN PATENT DOCUMENTS

| | | |
|---|---|---|
| 0252967 | 1/1988 | European Pat. Off. . |
| 670342 | 11/1929 | France . |
| 63-6319 | 1/1988 | Japan . |
| 63-311016 | 12/1988 | Japan . |
| 275496 | 8/1927 | United Kingdom . |
| 756046 | 8/1956 | United Kingdom . |
| 985817 | 3/1965 | United Kingdom . |
| 1357276 | 6/1974 | United Kingdom . |

*Primary Examiner*—Edward G. Favors
*Attorney, Agent, or Firm*—Foley & Lardner

[57] ABSTRACT

A system for discharging ash comprises a hopper provided with a system of hydraulically activated valves having the function of separating the hopper environment from the extractor environment, thereby creating an accumulation store inside the hopper which allows brief shutdowns for any required maintenance in the downstream extractor and the plant, and which prevents the direct falling of large lumps of agglomerated ash onto the belt and also, in the case of a multifuel boiler, avoids radiation to the extraction belt when gas or oil is used as fuel. Downstream of the area of ash discharge from the extractor a system of crushing, cooling, transport and storage of the ash is also provided.

30 Claims, 8 Drawing Sheets

SYSTEM FOR DISCHARGING BOTTOM ASH FROM STEAM-PRODUCING BOILERS

The present invention relates to a bottom ash discharge system for steam-producing boilers, which integrates and improves the apparatus for continuous dry removal of bottom ash described in the prior art European Patent No. 0 252 967 B1 of the same applicant, corresponding to U.S. Pat. No. 4,887,539.

In this European patent in fact an apparatus is described based on a conveyor belt able to withstand high temperatures and constructed so as to allow expansion in any direction, and consisting of two separate but joined elements which carry out separate functions of load support and of driving. This belt is enclosed in a tight sealed steel box applied to the boiler bottom, in such a way that the belt receives and discharges the ash continuously.

Since this apparatus functions excellently and already constitutes an optimum solution to the problem of dry extraction of bottom ash from boilers, it is considered that an ash interception system between the bottom of the boiler and the conveyor belt would be useful, in order to permit brief stoppings of the belt for maintenance, avoiding the direct falling of large lumps of collected ash onto the belt and eliminating the useless radiation of the belt when a polycombustible boiler is oil or gas fed.

The present invention resolves this problem perfectly in as much as it provides the joining of the extractor to the boiler by means of a transition ash feeder which is utilized as an accumulator and the bottom of which can be closed by a series of hatch valves.

This allows brief maintenance operations to be carried out on the extractor and in the machinery joined to it without having to interrupt the function of the boiler, given that the hopper constitutes an accumulator store of considerable capacity.

Furthermore the hopper with the hatch valves and the belt re-radiate the heat in the combustion chamber, contributing to increase the efficiency of the steam generator. This fact constitutes a notable advantage with respect to traditional wet, ash extraction systems where the combustion chamber, through a slit in the bottom looks on to a reflection of water in which the thermal flow is dispersed.

The intermediate position of semi-opening of the hatch valves, while it allows the passage of ash with normal granulometry, impedes the violent impact on the belt of lumps of larger size, and the presence of these large lumps of ash in the hopper are noticed by the operator who opens the valves completely thus provoking the directed fall on to the belt. The controlling can be carried out by any suitable means, for example an infrared telecamera.

In the prior art European patent 0 252 967 no specific treatment of the ash after its discharge from the extractor is described, and only the fact that a cyclically operated valve could be provided to limit or prevent the entrance of false air was mentioned.

In the system of the present invention, however, a predetermined quantity of outside air is used which, resucked by the negative pressure existing in the boiler, is passed in countercurrent to the ash and the belt, in this way the cold air exchanges heat with the system and the ash and feeds the combustion of the unburnt matter. This heat is reintroduced in the boiler contributing to increase the efficiency of the boiler and/or reduce the consumption of the combustible matter. The ashes, deprived of the unburnt matter, are transformed from a polluting product into a valuable and ecologically compatible component.

The present invention also provides, as a possible completion for the extraction process, a system of crushing and pneumatic transport of suitable ash to obtain bottom ash crushed to the point of being dispersable in the fly ash which is transported by smoke and deviated mostly by electrostatic precipitators.

Some types of coal and particular working conditions of the steam generator can provoke the formation of large agglomerates of ashes which precipitate irregularly on the bottom of the boiler.

These incrustations produce a reduced thermal exchange surface with the cooling fluid and therefore a pre-crusher was inserted in the discharge casing of the extractor with the function of breaking the large incrustations.

The pre-crushing step allows:

The reduction of the incrustations into pieces which can be treated and transported by the crushing systems downstream; and the increasing of the exchange surfaces between the ash and the cooling fluid.

If the solid fuel burnt in the boiler has a high percentage of ash or if the ash often agglomerates in large lumps, a postcooling-conveyor belt can also be used downstream of the extractor. The conveyor belt is preferably of the type described in the abovementioned prior art European patent 0 252 967 that is a belt enclosed in a steel box, equipped with a dust collecting chain.

The solution allows:

Achievement of the complete cooling to below melting point even of large incrustations of ash, which keep the melted core protected by the crust solidifying on the exterior;

the increase of the contact time between the ash and the cooling fluid;

the raising of the ash to a height so as to allow subsequent treatments by gravity;

the achievement of a smooth by-pass of the whole of the post-treatment plant in the event of maintenance operations;

the achievement of a complete combustion of the unburnt matter, particularly when the extractor is applied in a boiler having burners with low NOX.

Downstream of the post-cooling, the ash, having completely reached the solidifying temperature, is reduced by a suitable crushing cycle and to a size compatible with any mixing with the fly ash and then collected in an intermediate silo accumulator before subsequent pneumatic or mechanical transport.

This solution breaks the continuity between the processes of extraction, crushing and transport, with the following positive aspects:

Reduction of the working time of the transport elements downstream of the extractor and consequent reduction of wear and tear;

Optimal operation with constant loading of the pneumatic transport system;

Non-influence of any inefficiency of the crushing and transport system on the continuity of the operation of the steam generator.

The crushing is normally divided in three stages, and precisely a pre-crushing which coarsely reduces the lumps of exceptional size, a second intermediate, and finally a crushing which reduces the size of the pieces to a fineness that can be pneumatically transported.

The transport system below the extractor can be realised either by mechanical systems or pneumatic systems. The pneumatic system, however, seems preferable, because, due to its smaller bulk, it is more suitable to be installed as an addition to already existing plants.

The objects, characteristics and advantages of the system according to the present invention appear however even clearer and evident from the following detailed description of a preferred form of embodiment, reported though as a purely illustrative example and not limiting of the scope of the patent, and made with reference to the various diagrams in the annexed sheets of illustrative drawings, in which.

Figure 1:
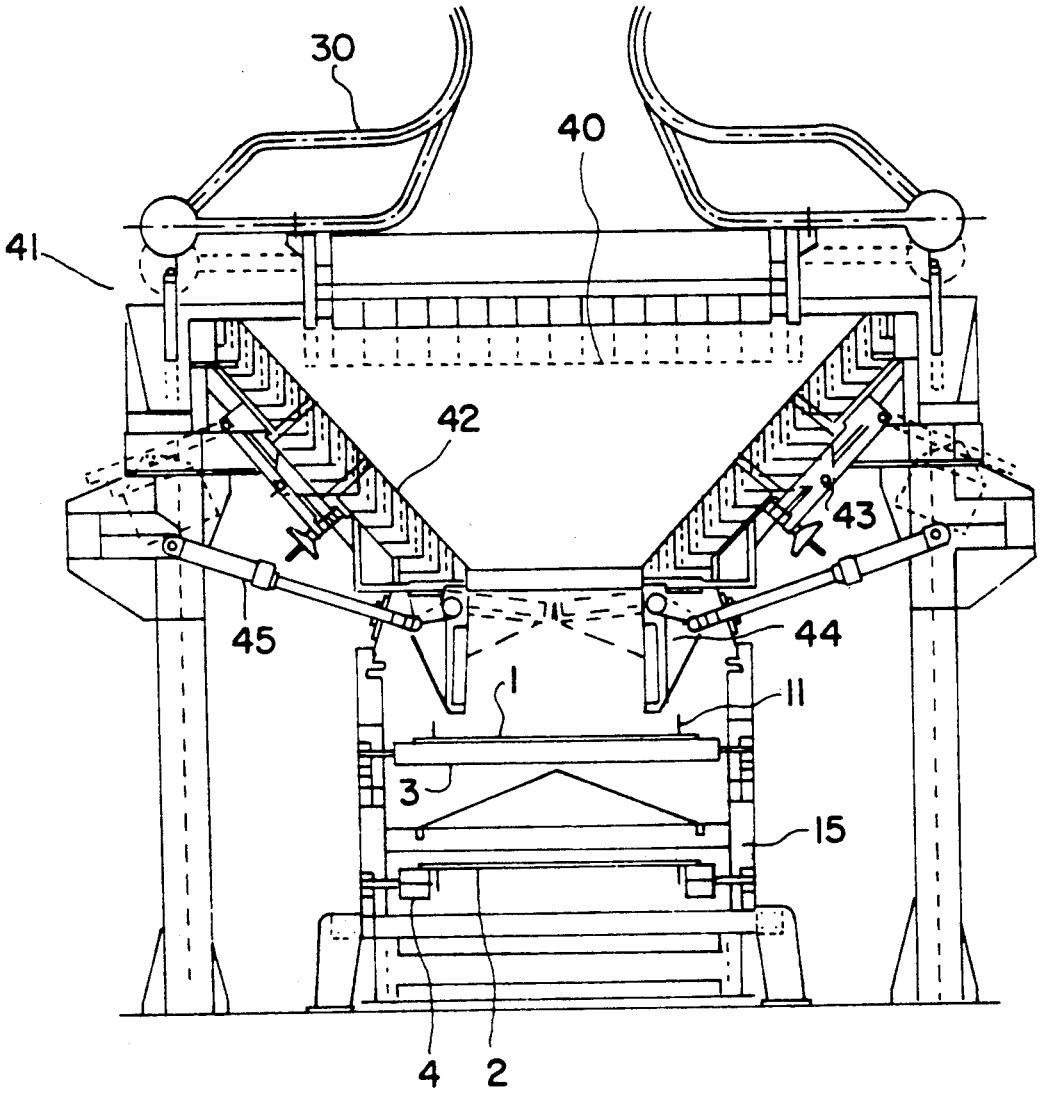
FIG. 1 is a partially sectioned top view of the area of the boiler bottom, with the transition hopper and the extractor.
Figure 2:
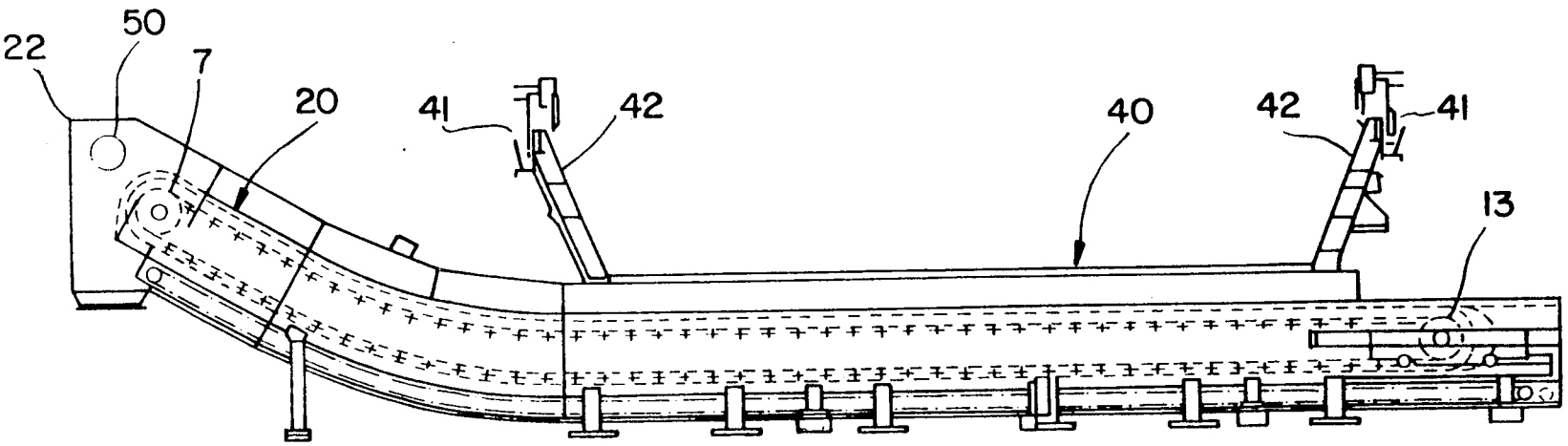
FIG. 2 is a drawing of the extractor.

Referring first to FIGS. 1 and 2, in these various elements already described in the prior art European patent 0 252 967 are seen which for convenience are indicated with the same reference numbers assigned to them in that patent. The extractor, indicated as a whole in FIG. 2 with the reference number 20, is constituted by the conveyor belt formed by a series of steel plates 1, having lateral boards 11, which accomplish the function of supporting the load, while the traction is carried out by a steel wired belt 2 friction activated by cylindrical driving drum 7 and tensioned by a jockey drum 13. The upper load bearing run of the belt is supported by smooth rollers 3, while the lower return run is supported by wheels 4, the whole being supported by a containing box 15. Further details of the structure and functioning of the extractor are as follows.

What is needed for effecting a dry removal of hot bottom ash is a particular conveyor belt, adapted to withstand high temperature and provided with means adapted to confer tightness around the boiler bottom.

From U.S. Pat. No. 3,633,737 there is known a friction driven steel conveyor belt consisting of a plurality of steel plates partially overlapping so as to form a continuous trough and having the loading bearing function, and a high strength steel wired belt having the driving function.

Starting from such a steel conveyor belt disclosed in U.S. Pat. No. 3,633,737, the above mentioned problems are solved by an apparatus for continuous dry removal of bottom ash having the conveyor belt enclosed in a tight sealed steel box applied to the boiler bottom and such that each plate is individually fixed to the steel wired belt by means of fasteners such as rivets or bolts connected to crosspieces inserted in the links of the conveyor belt, so as to allow free expansion of the plates in any direction.

This improved steel conveyor belt is actually a conveyor belt, as its driving element is a steel wire belt adapted to be wound around a cylindrical drum, that is tensioned by a tension drum and is supported by a number of idle rollers.

The plates fixed to the net-like belt are partially overlapping so as to constitute a continuous load bearing plane, and they protect the steel belt from the mechanical and thermal stress due to the conveyed heavy ash, as the connection between the driving part and the load bearing part is very little and greatly reduces heat and stress transmission.

As the motion transmission between driving drum and net-like wire belt is obtained only by friction and not through a positive mating between chain and sprocket, and as the connection between plates and wire belt is obtained through rivets and bolts free to move inside the wire belt, it is clear that the extensions due to heat do not find resistance points and therefore do not cause permanent deformations or distortions.

It is also clear that a conventional conveyor belt could not be used for removing heavy ash, but only a special steel conveyor belt such as disclosed here, which is a novel solution to the problem of how to use a conveyor belt enabling dry removal of heavy ash. One of the main advantages of the system disclosed here is that it does not require a cooling liquid such as water, as water is a valuable and limited substance and downstream from the plant it has to be purified, with enormous costs and complicated equipment to remove the polluting elements from the water.

Moreover, in the modern steam boilers fed with coal in the power plants, temperatures inside the combustion chamber are so high that ash melts and forms agglomerated blocks having big sizes, sometimes even more than half a cubic meter, and only with the system disclosed here is it possible to remove these blocks without introducing false air in the boiler, as air is intercepted downstream from the ash discharge system.

The steel belt conveyor is made so as to withstand mechanical stress due to ash impact and thermal stress due to burner radiation and the high temperature of the removed ash.

This system allows free expansion of the plates in every direction according to temperature variations in order to avoid permanent set.

The steel wired belt is friction actuated by a cylindrical driving drum and it is stretched by a jockey drum on which a tensioning system is acting.

The driving system, based on friction and tension, allows the wired belt to have free expansion in any direction, avoiding permanent set.

Therefore the values of resistance to high temperatures of this system are equal to the values of heat resistance of the type of alloy steel used. Refractory steel with high chrome and nickel contents are normally used, but other alloys may be used as well.

Tension induced in the belt by the tensioning system acting on the jockey drum, causes a pressure between plates in their overlapping areas; such a pressure between plates for the whole belt length prevents passage of even the smallest particles.

The load bearing run of the belt is supported by smooth rollers while the return run is supported by cast iron or steel wheels.

Roller shafts protrude outside the container box, so that they can be supported by bearings arranged in a cool area. Between the shafts and the corresponding holes made in the box there are heat resistant seals preventing air entrance and gas passage, but allowing a sliding movement of the shafts due to expansion.

A cyclically operated valve limiting or preventing entrance of cool air, may be applied downstream the area of ash discharge from the apparatus.

In vacuum operated boilers, a quantity of air controlled by the above system may be delivered countercurrently to the direction of ash discharge. In this way the heat yielded to air by ash and by the combustion of the unburnt matter on the belt, is brought again into the boiler so as to increase its efficiency.

The above indicated system has a number of advantages which are hereinafter briefly enumerated:

(a) Removal and conveyance of ash even of big size without requiring prior crushing.
(b) Energy recovery from the unburnt coal portion.
(c) Industrial employ of dry ash not degraded by water and free from unburnt matter.
(d) Simplicity and reliability of the system built so as to avoid sudden halts.
(e) Energy saving in view of the low installed power in comparison with other systems.
(f) Reduction of areas required for the plant.
(g) Elimination of water transport and treatment systems.
(h) Reduction of installation and maintenance costs.

Figure 4:
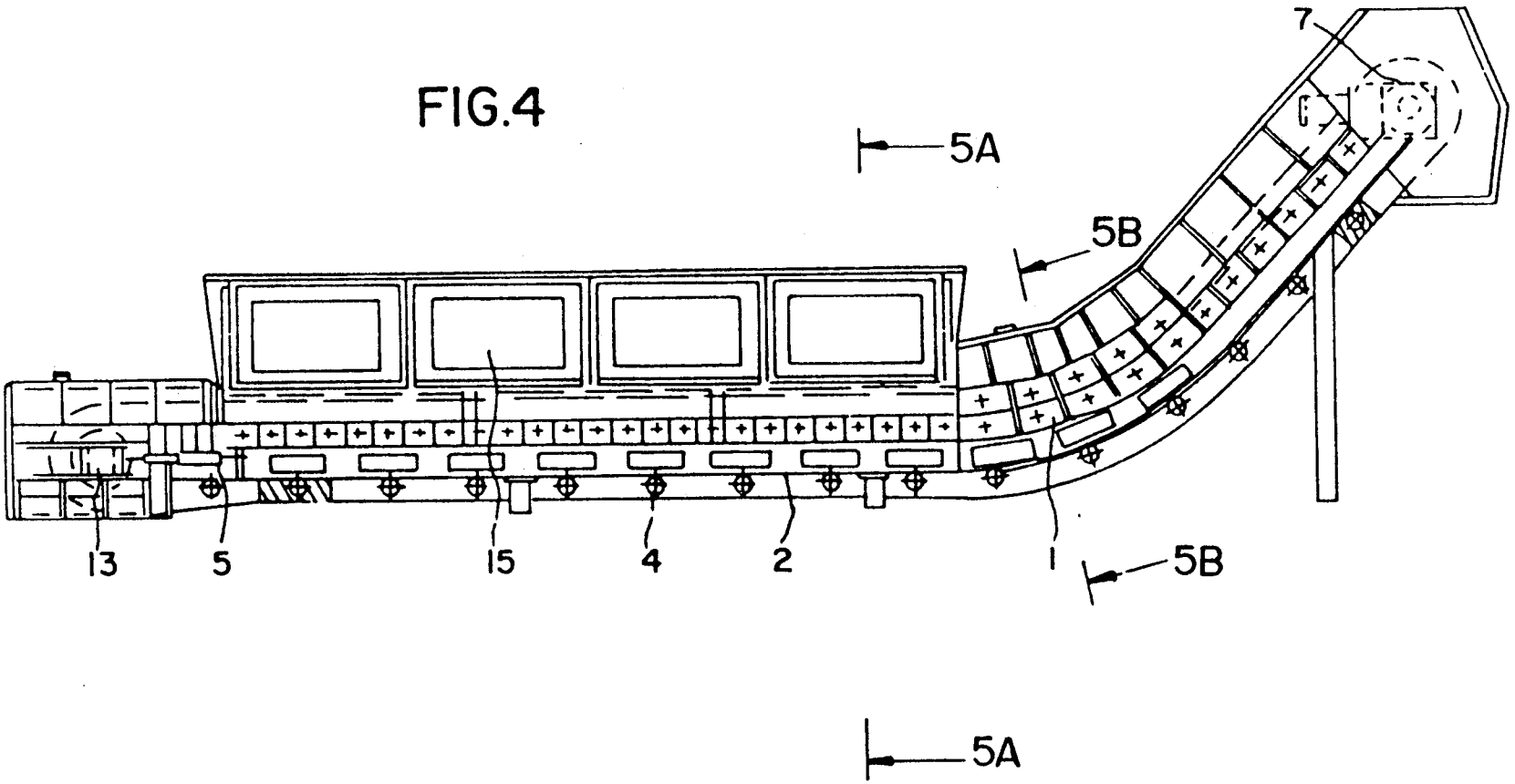
Figure 5B:
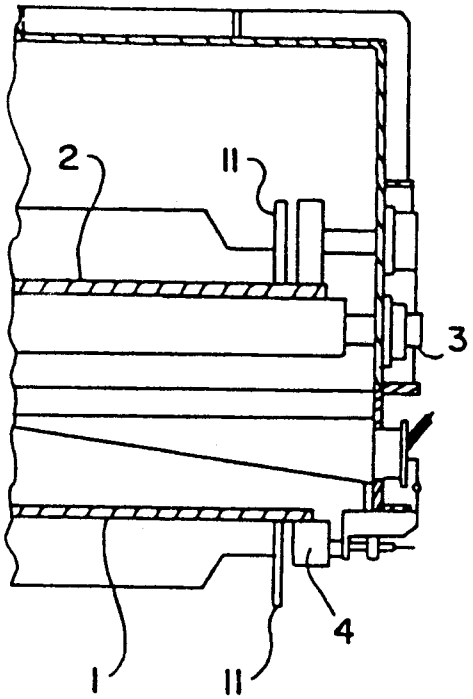
Figure 5A:
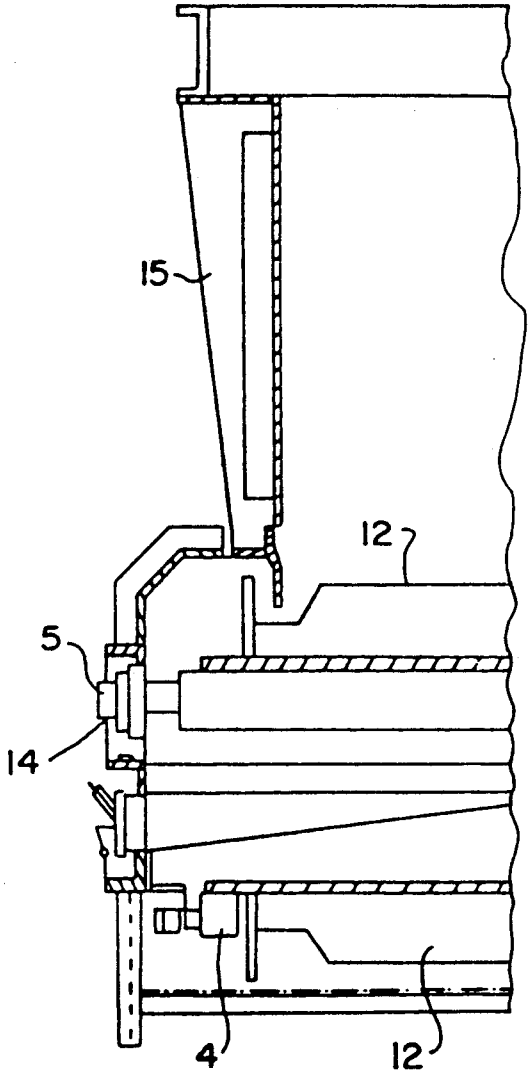
Figure 6:
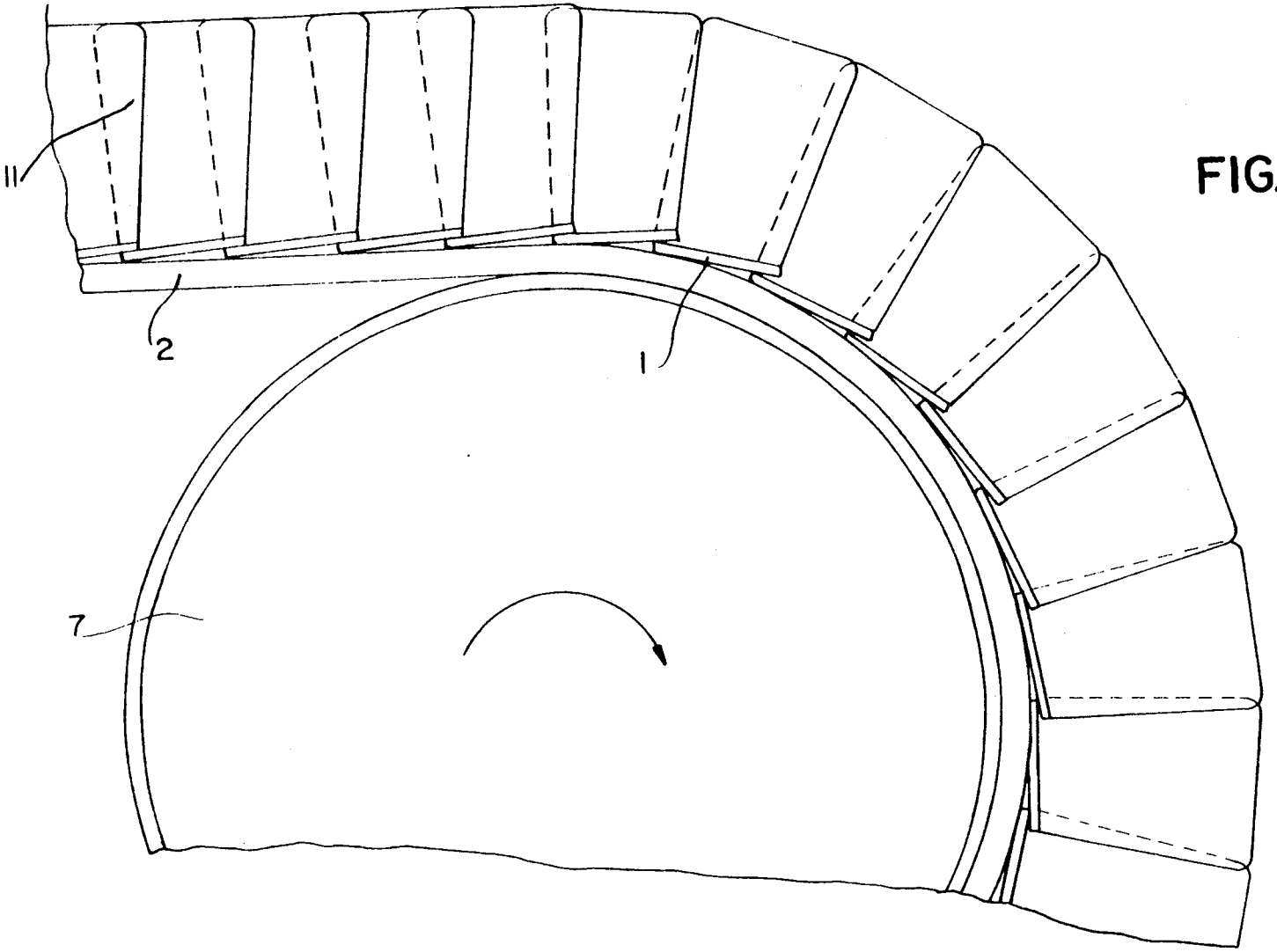
Figure 8:
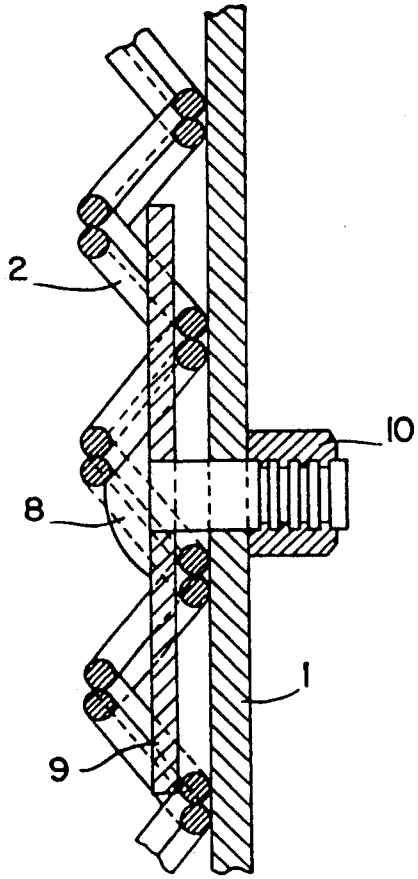
Figure 7:
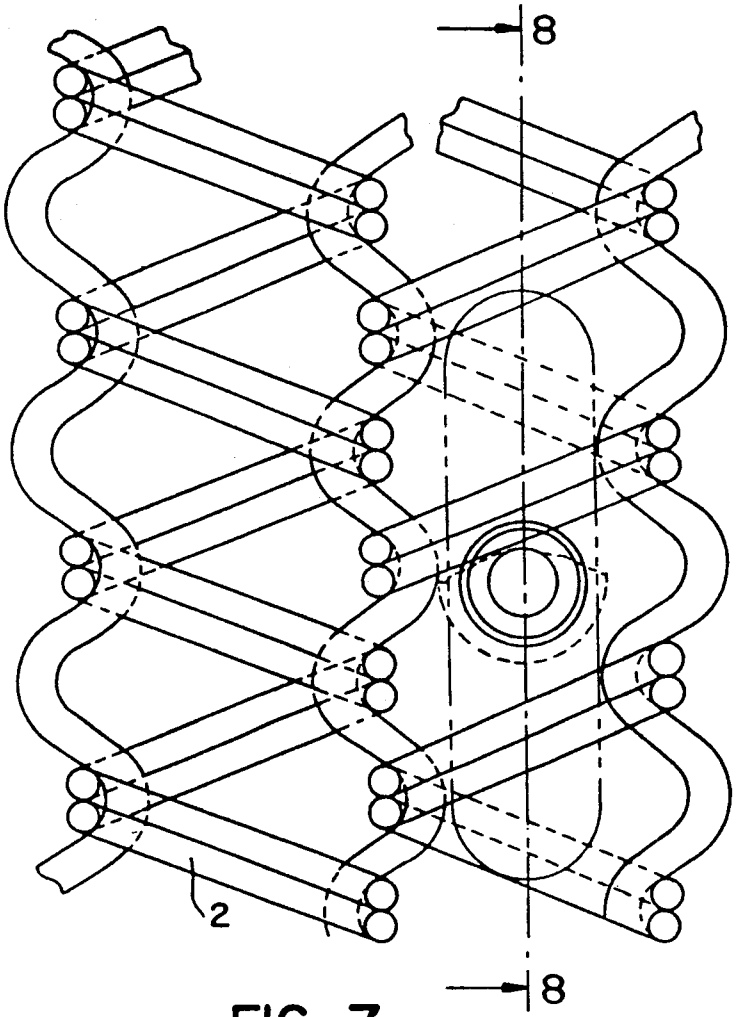
Figure 9:
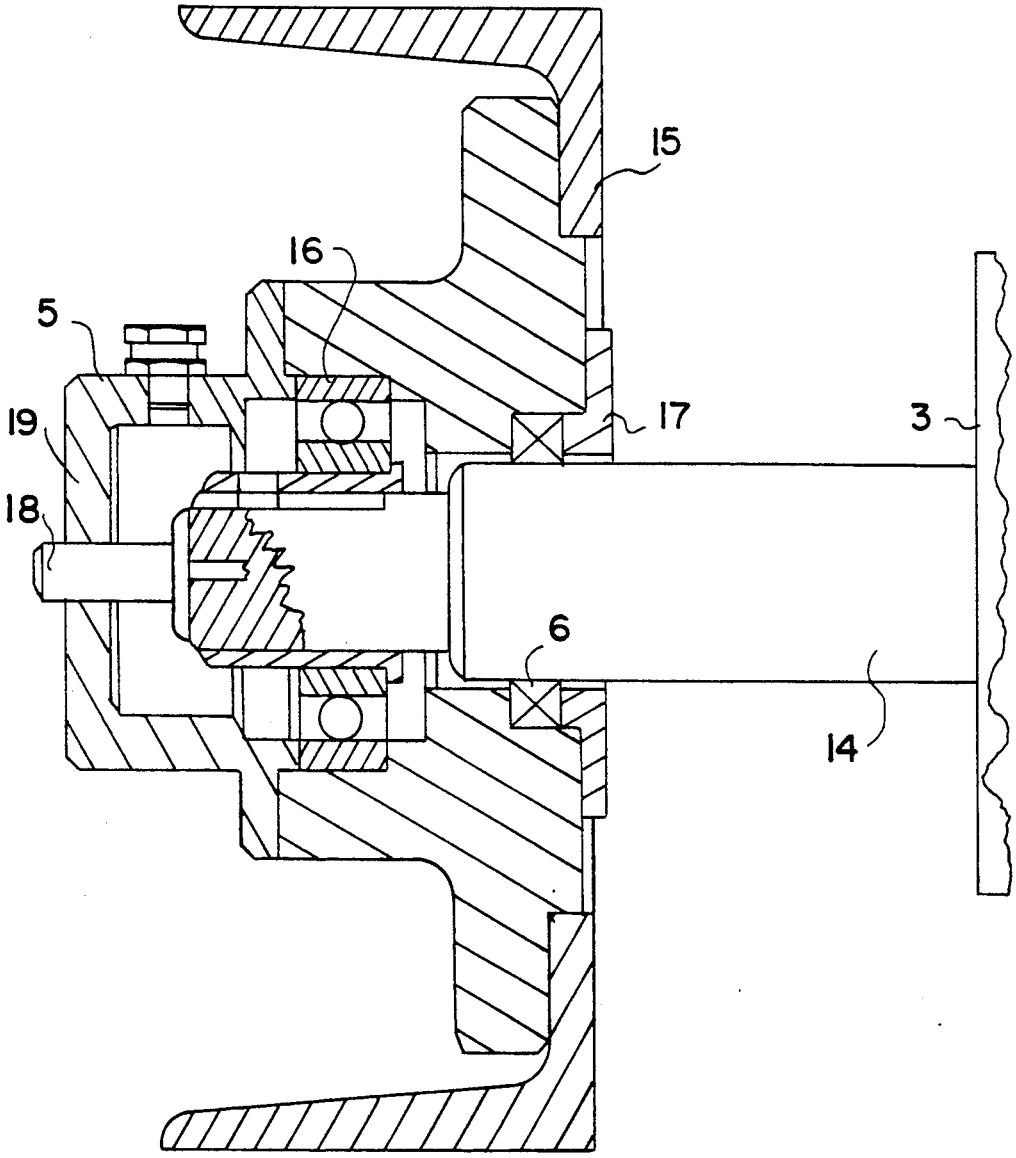

The apparatus disclosed here will be better understood from the following detailed description of a preferred embodiment, given only as a nonlimiting example of its scope, reference being had to the accompanying illustrative drawings, in which:

FIG. 4 is a lateral general view of an embodiment of the apparatus;

FIGS. 5(*a–b*) is a vertical sectional view of the apparatus, taken in the left-hand portion along line X—X and in the right-hand portion along line Y—Y of FIG. 4;

FIG. 6 is a detailed view of the passage of the conveyor belt on the driving drum;

FIG. 7 is a detailed bottom view of a portion of the conveyor belt;

FIG. 8 is a sectional view taken along line Z—Z of FIG. 7 showing the structure of the conveyor belt; and FIG. 9 is a partially sectioned elevational view, showing the detail of the support particularly designed for the rollers bearing the conveyor belt.

With reference to the various figures of the accompanying FIGS. 4–9, the apparatus comprises a steel conveyor belt consisting of a plurality of steel plates 1 suitably shaped and partially overlapping so as to form a continuous trough. Each plate 1 is provided with lateral boards 11 and some plates have also transverse dams 12 for dividing the trough into sections, so as to avoid a condition in which the material slides back in the inclined stretches. Thus, these plates 1 have the load bearing function, while the driving function is effected by a high strength steel wired belt 2. Each plate 1 is individually fixed to belt 2 by bolts 8 with relevant nut 10, which however may be replaced by rivets or other equivalent fasteners, which are connected to crosspieces 9 suitably inserted in the links of said wired belt 2. This open system allows free expansion of plates 1 in any direction when temperature changes, so as to avoid permanent set.

The steel wired belt 2 is friction actuated by a cylindrical driving drum 7 and it is tensioned by a jockey drum 13 on which a tensioning device is acting, said device being not illustrated in greater detail as it is well known in the conveyor technique. This driving system, based on friction and tension, also allows the wired belt 2 to undergo free expansion in any direction, so as to avoid permanent set.

The load bearing run of the belt is supported by smooth rollers 3, while the lower return run is supported by cast iron or steel wheels 4. Shafts 14 of smooth rollers 3 protrude outside a steel containing box 15, which is applied at the boiler bottom, so that ash is falling on the conveyor belt enclosed therein and said shafts 14 may be supported outside the hot environment by bearings 16, thus arranged in a cool area and supported by specially designed supports 5. Between shafts 14 and corresponding holes 17 made in the box 15, there are heat resistant seals 6, preventing air entrance and gas passage, but allowing shafts 14 to slide because of expansion. A guide and adjustment pin 18 protrudes from a hole made in support 5 and provided with a sealing gasket 19.

Between the extractor 20 and the boiler 30 according to the present invention the transition hopper 40 is provided, which is attached to the boiler bottom by the hydraulic guard 41. The hopper comprises lateral walls 42 suitably coated internally in refractory material and having inspection windows 43. The bottom of the hopper is provided with hatch valves 44, also coated in refractory material on the side exposed to the flame, and provided with hinges for attachment either to the structure of the hopper or to the hydraulic cylinders 45 which activate the movement.

In FIG. 1 the fully open position of said valves 44 is illustrated in whole lines and the completely closed position in broken lines. However their normal working position is the intermediate semi-open position, more or less as a continuation of the inclination of the lateral walls 42 of the hopper, so as to stop any lumps of agglomerated ash, in which case the operator opens the valves 44 totally to let the lumps fall gently on the belt, while the totally closed position is employed when brief stoppings of the belt must be effected, in this case the hopper serves as an accumulation store, or when a polycombustible boiler is oil or gas fed rendering the use of the extractor superfluous.

Figure 3:
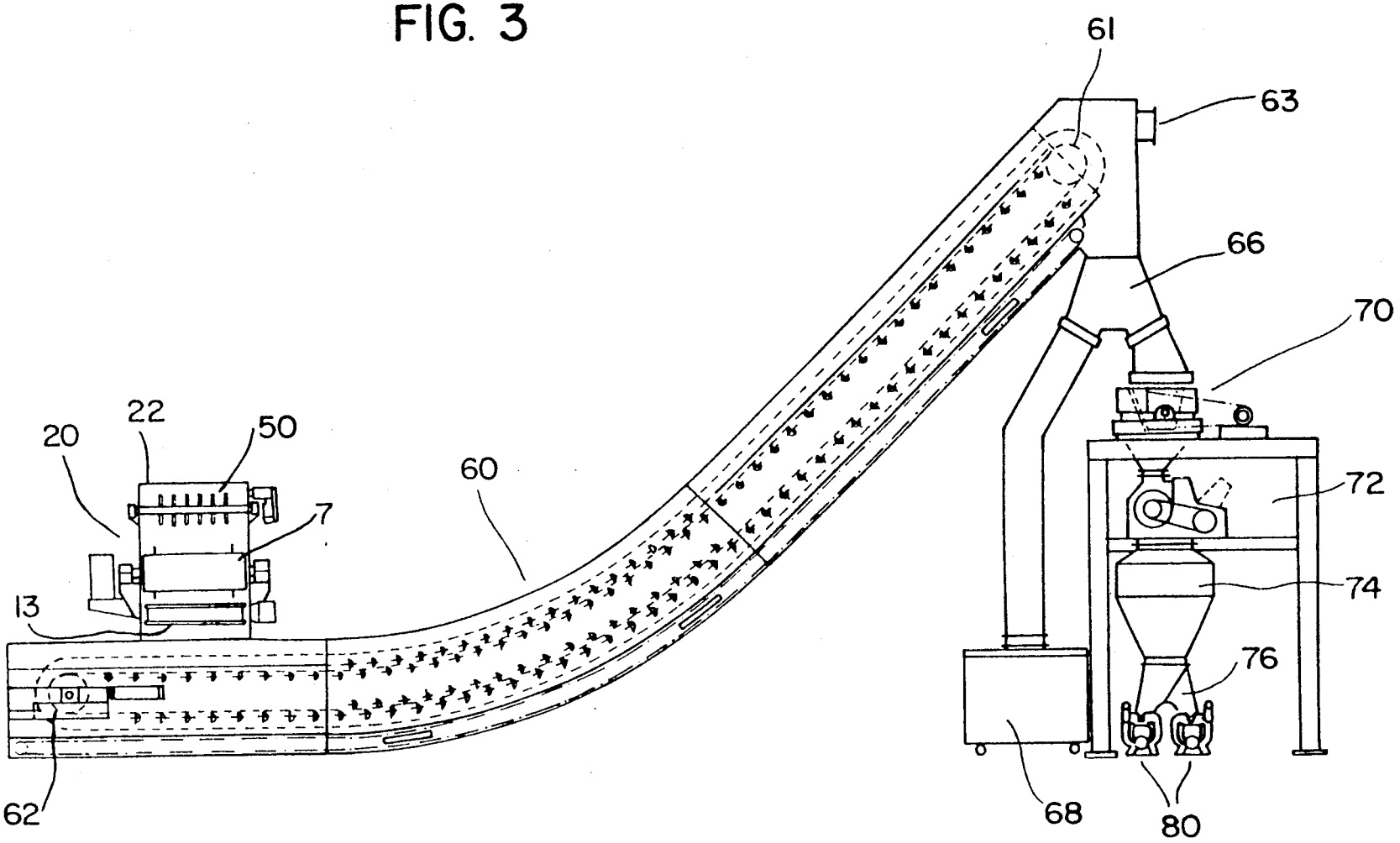
FIG. 3 is a drawing of the crushing, cooling and transport complex.

Now referring to FIGS. 2 and 3, the crushing, cooling and transporting system of the ash discharged from the extractor 20 can also be seen. Said ashes are first ground in a pre-crusher 50 or preferably realised as a mill with rotating hammers, situated in the discharge casing 22 of the extractor 20 above the driving drum 7.

From the pre-crusher 50 the coarsely crushed ash can fall on to a second conveyor 60 which can be of analogous type to the extractor 20, and therefore driven by a driving drum 61 and tensioned by a jockey drum 62. This second conveyor has the function of a conveyor belt and post-cooler of the ash which is cooled by a countercurrent air flow introduced by means of one or more openings such as entrance 63 situated at the upper extremity of ash discharge, and which is sent to a primary crusher 70 and then a secondary crusher 72. From the latter the ash, by now reduced to a pneumatically transportable size, is fed to an accumulation hopper 74 and from here sent to a deviator 76 to the transport systems which can be composed of pneumatic pumps 80, ejectors or exhausts. Above the primary crusher 70 an emergency deviator 66 is situated which permits deviation of the ashes if necessary to an emergency accumulation box 68.

The system is modular and therefore in its entirety allows the achievement of dry ash crushed to the point of being able to be mixed with fly ash and thus easily recyclable particularly in the construction material industry as a component of cement or concrete. The crushing system allows the ash to be dry ground in order to obtain pieces of various size according to subsequent industrial uses. The crushing system is constituted by one or more devices which allow the dry crushing to a fineness that enables it to be mixed with fly ash with extreme simplification of the plant.

However, for reasons of economy, one can exclude totally or partially the crushing system elements, thus obtaining coarse sized ash.

The post-cooler can be unemployed by connecting the crushing system to the primary extractor when using coal with modest quantities of ash.

One can therefore see from the foregoing that the system according to the present invention fully achieves the pre-established objects and constitutes a complete plant for the treatment of bottom ash from steam-generating boilers, but one must again remember that the system has been described as exemplary in its illustrative form of embodiment represented by the drawings, and therefore numerous modifications, variations, additions and/or substitutions of elements can be made to it without departing from either the spirit or the object of the invention, and also without going out of its scope of protection, as has also been defined in the appended claims.

I claim:

1. A bottom ash dry discharge system for a steam-generating boiler, comprising a modular system having:

(a) an extractor including a conveyor belt resistant to high temperatures, constructed so as to allow expansion in any direction, the conveyor belt having two separate but joined elements for performing, respectively, the functions of load support and driving;

(b) a tight sealed box supporting the extractor;

(c) a transition hopper attached to a bottom of the boiler and united to the extractor; and (d) apparatus for crushing, cooling, and transporting dry ash discharged from the extractor.

2. A bottom ash discharge system for a steam-generating boiler, comprising a modular system having:

(a) an extractor including a conveyor belt resistant to high temperatures, constructed so as to allow expansion in any direction, the conveyor belt having two separate but joined elements for performing, respectively, the functions of load support and driving;

(b) a tight sealed steel box supporting the extractor;

(c) a transition hopper attached to a bottom of the boiler and united to the extractor; and (d) apparatus for crushing, cooling, and transporting ash discharged from the extractor;

wherein one element of the conveyor belt is composed of a series of steel plates forming a continuous trough for performing the load supporting function, and another element of the conveyor belt is a steel wired belt, having high resistance, for performing the driving function.

3. The system according to claim 1, wherein the transition hopper includes a hatch valve on the bottom for providing an accumulation store on the inside of said hopper.

4. The system according to claim 3, wherein the hatch valve can assume a normal working position, a closed position for preventing discharge of ash during times when the extractor temporarily stops, and an open position for discharging lumps of agglomerated ash.

5. The system according to claim 1, wherein the hopper includes a hatch; and wherein the hopper, hatch and conveyor belt face a flame in the boiler and consequently re-irradiate thermal flow in the boiler contributing to increasing the efficiency of the boiler.

6. The system according to claim 1, wherein the crushing, cooling and transporting apparatus includes a postcooler having at least one opening for outside air which, resucked by the negative pressure existing in the boiler, is made to pass in countercurrent to the ash and the belt, thus exchanging heat with the discharge system and the ash and feeding the combustion of the unburnt matter, this heat being reintroduced in the boiler contributing to increasing its efficiency.

7. A bottom ash discharge system for a steam-generating boiler, comprising a modular system having:

(a) an extractor including a conveyor belt resistant to high temperatures, constructed so as to allow expansion in any direction, the conveyor belt having two separate but joined elements for performing, respectively, the functions of load support and driving;

(b) a tight sealed steel box supporting the extractor;

(c) a transition hopper attached to a bottom of the boiler and united to the extractor; and (d) apparatus for crushing, cooling, and transporting dry ash discharged from the extractor;

wherein the crushing, cooling, and transporting apparatus includes a precrusher for reducing incrustations of exceptional dimensions in order to increase thermal exchange surfaces with cooling fluid in a postcooler.

8. The system according to claim 1, including a boosted cooling system for lowering a temperature of the dry ash to below its melting point.

9. The system according to claim 1, wherein the crushing apparatus allows the ash to be dry ground in order to obtain pieces of various size according to subsequent industrial uses.

10. The system according to claim 1, wherein the crushing apparatus includes at least one device for dry crushing the ash to a fineness that enables the ash to be mixed with fly ash.

11. A method for dry discharge of bottom ash from a steam-generating boiler comprising the steps of:

discharging any bottom ash from the boiler;

guiding the dry bottom ash through a transition hopper;

receiving, from the transition hopper, the dry bottom ash onto a conveyor belt;

discharging the dry bottom ash from the conveyor belt; and crushing, cooling, and transporting the dry bottom ash discharged from the conveyor belt;

wherein the transition hopper includes a hatch valve, and further comprising the step of re-irradiating thermal flow in the boiler by facing the transition hopper, hatch valve, and conveyor belt onto a flame in the boiler.

12. The method of claim 11, wherein the transition hopper includes a match valve and wherein the step of guiding the dry bottom ash through a transition hopper includes the step of positioning the hatch valve in a normal working position.

13. The method of claim 11, wherein the transition hopper includes a hatch valve and wherein the step of guiding the dry bottom ash through a transition hopper includes the step of positioning the hatch valve in a closed position for preventing discharge of ash from the transition hopper during times when the conveyor belt temporarily stops.

14. The method of claim 11, wherein the transition hopper includes a match valve and wherein the step of guiding the dry bottom ash through a transition hopper includes the step of positioning the hatch valve in an open position for discharging lumps of agglomerated ash from the transition hopper.

15. The method of claim 11, wherein the step of crushing, cooling, and transporting the dry bottom ash includes drawing outside air through at least one opening in a postcooler, passing the outside air in countercurrent to the ash and the conveyor belt, thus exchanging heat with a discharge system and the ash and feeding the combustion of unburnt matter, and reintroducing this heat into the boiler.

16. The method of claim 11, wherein the step of crushing, cooling, and transporting the dry bottom ash includes precrushing the ash in a precrusher for reducing incrustations of exceptional dimensions in order to increase thermal exchange surfaces with cooling fluid in a postcooler.

17. The method of claim 11, further comprising the step of lowering the temperature of the dry bottom ash to below its melting point using a boosted cooling system.

18. The method of claim 11, wherein the step of crushing, cooling, and transporting the dry bottom ash includes the step of dry grinding the dry bottom ash for obtaining pieces of various size according to subsequent industrial uses.

19. The method of claim 11, wherein the crushing, cooling, and transporting step includes the step of dry crushing the dry bottom ash to a fineness that enables the dry-crushed ash to be mixed with fly ash.

20. The system according to claim 1, wherein the tight sealed box is a steel box; and wherein one element of the conveyor belt is composed of a series of steel plates forming a continuous trough for performing the load supporting function, and another element of the conveyor belt is a steel wired belt, having high resistance, for performing the driving function.

21. The system according to claim 1, wherein the crushing, cooling, and transporting apparatus includes a precrusher for reducing incrustations of exceptional dimensions in order to increase thermal exchange surfaces with cooling fluid in a postcooler.

22. A method for dry discharge of bottom ash from a steam-generating boiler comprising the steps of:

discharging dry bottom ash from the boiler;

guiding the dry bottom ash trough a transition hopper;

receiving, from the transition hopper, the dry bottom ash onto a conveyor belt;

discharging the dry bottom ash from the conveyor belt; and crushing, cooling, and transporting the dry bottom ash discharged from the conveyor belt;

wherein the step of crushing, cooling, and transporting the dry bottom ash includes drawing outside air through at least one opening in a postcooler, passing the outside air in countercurrent to the ash and the conveyor belt, thus exchanging heat with a discharge system and the ash and feeding the combustion of unburnt matter, and reintroducing this heat into the boiler.

23. The method of claim 22, wherein the transition hopper includes a hatch valve and wherein the step of guiding the dry bottom ash through a transition hopper includes the step of positioning the hatch valve in a normal working position.

24. The method of claim 22, wherein the transition hopper includes a hatch valve and wherein the step of guiding the dry bottom ash through a transition hopper includes the step of positioning the hatch valve in a closed position for preventing discharge of ash from the transition hopper during times when the conveyor belt temporarily stops.

25. The method of claim 22, wherein the transition hopper includes a hatch valve and wherein the step of guiding the dry bottom ash through a transition hopper includes the step of positioning the hatch valve in an open position for discharging lumps of agglomerated ash from the transition hopper.

26. The method of claim 22, wherein the transition hopper includes a hatch valve, and further comprising the step of re-irradiating thermal flow in the boiler by facing the transition hopper, hatch valve, and conveyor belt onto a flame in the boiler.

27. The method of claim 22, wherein the step of crushing, cooling, and transporting the dry bottom ash includes precrushing the ash in a precursor for reducing incrustations of exceptional dimensions in order to increase thermal exchange surfaces with cooling fluid in a postcooler.

28. The method of claim 22, further comprising the step of lowering the temperature of the dry bottom ash to below its melting point using a boosted cooling system.

29. The method of claim 22, wherein the step of crushing, cooling, and transporting the dry bottom ash includes the step of dry grinding the dry bottom ash for obtaining pieces of various size according to subsequent industrial uses.

30. The method of claim 22, wherein the crushing, cooling, and transporting step includes the step of dry crushing the dry bottom ash to a fineness that enables the dry-crushed ash to be mixed with fly ash.

* * * * *